US005140832A

United States Patent [19]

Deininger et al.

[11] Patent Number: 5,140,832

[45] Date of Patent: Aug. 25, 1992

[54] REFRIGERATION SYSTEM FOR A BEVERAGE DISPENSER

[75] Inventors: Anton Deininger, Vogtstrasse Bachhagel; Klaus Erdmann, Mergelstetten, both of Fed. Rep. of Germany

[73] Assignees: The Coca-Cola Company, Atlanta, Ga.; Bosch-Siemens Hausgerate GmbH, Munich, Fed. Rep. of Germany

[21] Appl. No.: 625,058

[22] Filed: Dec. 10, 1990

[51] Int. Cl.[5] ..... B67D 5/62

[52] U.S. Cl. ..... 62/389; 62/390; 62/393

[58] Field of Search ..... 62/383, 389-393

[56] References Cited

U.S. PATENT DOCUMENTS

| | | | |
|---|---|---|---|
| 3,323,681 | 6/1967 | Di Vette et al. | 62/389 X |
| 3,422,634 | 1/1969 | Brown | 62/390 |
| 3,998,070 | 12/1976 | Mueller | 62/393 |
| 4,440,318 | 4/1984 | Berger | 62/390 X |
| 4,493,441 | 1/1985 | Sedam et al. | 62/390 X |
| 4,566,287 | 1/1986 | Schmidt et al. | 62/390 X |
| 4,610,145 | 9/1986 | Arzberger et al. | 62/390 X |
| 4,674,656 | 6/1987 | Wiley et al. | 62/390 X |
| 4,860,923 | 8/1989 | Kirschner et al. | 62/389 X |
| 4,916,910 | 4/1990 | Schroeder | 62/390 X |

*Primary Examiner*—Henry A. Bennet
*Assistant Examiner*—Christopher B. Kilner
*Attorney, Agent, or Firm*—Birch, Stewart, Kolasch and Birch

[57] ABSTRACT

In a post-mix beverage dispenser a heat conducting plate assembly couples the bottom wall of a carbonator tank to the side walls of beverage concentrate storage tanks for the bi-directional transfer of heat therebetween. The cold temperature of the carbonator tank including an ice bank therein chills the concentrate to help achieve a suitable serving temperature of a finished drink. The higher temperature of the concentrate helps warm the bottom area of the carbonator tank in the region of an outlet opening to preclude freezing of carbonated water in the outlet opening.

2 Claims, 1 Drawing Sheet

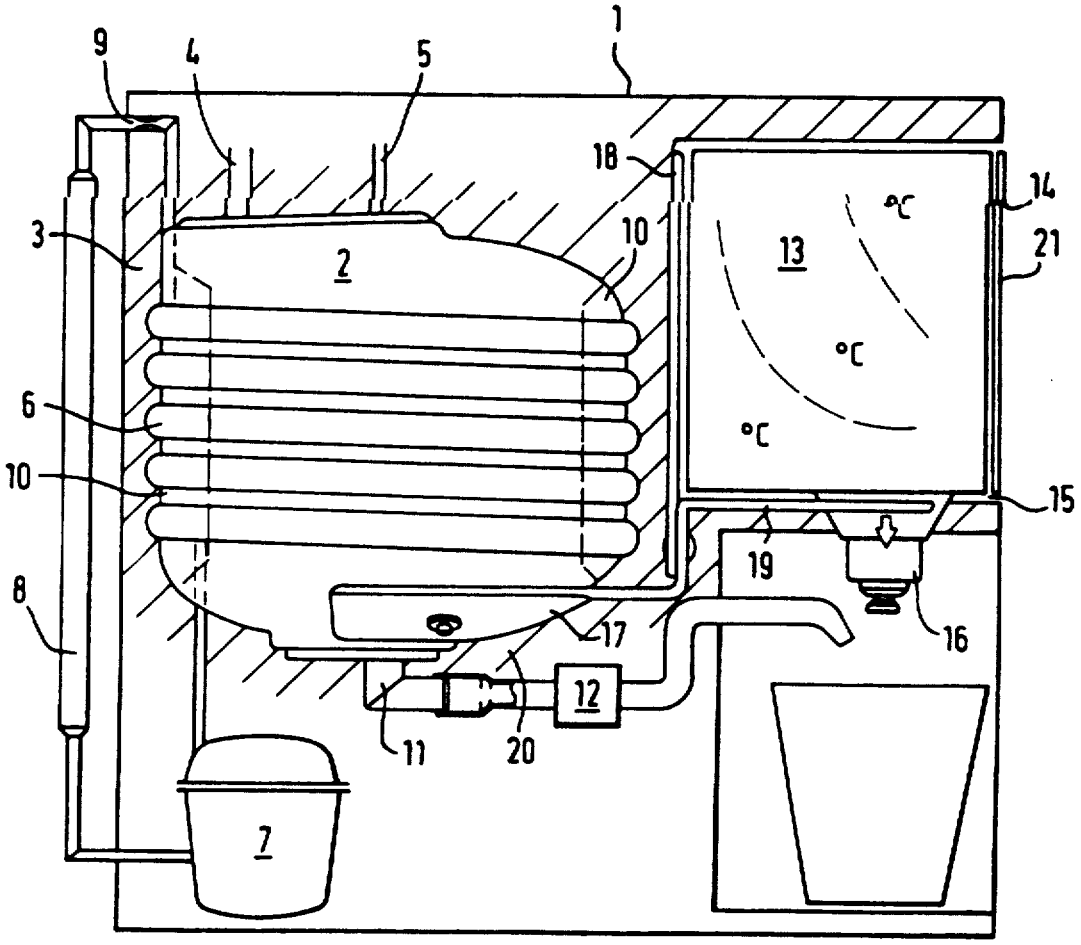
1
9
4
5
18
14
21
3
2
10
13
°C
°C
°C
6
10
15
19
8
17
16
12
11
20
7

REFRIGERATION SYSTEM FOR A BEVERAGE DISPENSER

BACKGROUND OF THE INVENTION

The present invention relates to a system for cooling the components of a post-mix beverage in a beverage dispenser. More specifically, the present invention relates to the provision of a heat sink assembly interconnecting a compartment of the beverage dispenser containing the carbonator and a compartment of the beverage dispenser containing the concentrate containers to beneficially transfer heat between the respective compartments.

In post-mix beverage dispensers which mix a diluent such as carbonated water and a beverage concentrate it is necessary that the water is sufficiently cooled to provide a drink of a proper temperature. The colder the water the better capacity it has for absorbing $CO_2$ gas to form carbonated water. Furthermore, since the amount of carbonated water in the final drink is several times the amount of beverage concentrate, the temperature of the carbonated water essentially determines the temperature of the final beverage of drink.

When cooling the carbonated water a natural limit is set which is determined by the freezing point of the carbonated water. In order to increase the cooling capacity when storing the carbonated water in a carbonator tank, a part of it will be stored as ice in the form of an ice bank around the perimeter of the tank. The thickness of the resulting ice bank serves as a criteria for the evaluation of the cooling capacity and the temperature of the carbonated water within the tank. As known the carbonated water is preferably cooled by the provision of cooling coils surrounding the carbonator tank. Systems of this type have a very high cooling efficiency.

It is desirable to also cool the beverage concentrates in storage containers therefor within the beverage dispenser prior to mixing of those beverage concentrates with carbonated water. One reason for cooling the beverage concentrate is to increase the shelf-life of the beverage concentrate and another reason is to ensure a proper serving temperature of the final post-mix drink mixture.

One conventional approach to cooling both the carbonated water and the beverage concentrate is to individually regulate and cool the respective components through separate means. This is generally done because the temperature and cooling requirements for the two beverage components are different from each other. For example, the temperature of the carbonated water is ideally as close as possible to the freezing point of the water. The beverage concentrate on the other hand should have a temperature which is low enough so that when mixed with the carbonated water near its freezing point the resulting temperature of the mixture is at the desired drink temperature. Typically the systems for individually regulating and cooling the carbonated water and beverage concentrate are complicated and expensive to manufacture.

SUMMARY OF THE INVENTION

Accordingly, it is a primary object of the present invention to provide an apparatus for cooling of carbonated water and beverage concentrates in a post-mix beverage dispenser which is simple in design and has a simple control mechanism for assuring the proper temperature of the resulting post-mix drink.

An apparatus which meets these requirements is characterized by the provision of a heat conducting element having an enlarged curvilinear plate conforming to a portion of the bottom wall of the carbonator tank of the post-mix beverage adjacent to the outlet opening through which carbonated water flows to a conduit for transporting the carbonated water to a mixing station of the dispenser. Extending from this enlarged, curvilinear heat conducting plate are arms or branches which extend into and form one or more walls of a concentrate storage compartment of the dispenser. For example, these arms or walls may constitute flat rectangular extensions of the enlarged curvilinear heat conducting plate conformally shaped to the bottom wall of the carbonator tank.

The carbonator tank is surrounded by a plurality of cooling coils in a conventional fashion which are in circuit with an evaporator condenser and the like of a conventional mechanical refrigeration system. Also in a conventional manner an ice bank is formed around the perimeter of the interior of the carbonator tank and appropriate ice bank thickness sensors are provided and connected in a feed back circuit with an electrical control means of the refrigeration system for turning the refrigeration system on and off to achieve the proper temperature of carbonated water within the carbonator tank.

The heat conducting element extending between the carbonator tank and the concentrate storage department transfers heat between the respective areas in a beneficial manner. For example the heat conducting element by virtue of its connection to the carbonator tank provides cooling for the beverage concentrates in the storage containers. Conversely, the relatively high temperature of the beverage concentrates provides a warming effect or heat transfer through the heat conducting element to the bottom wall of the carbonator tank. This warming of the bottom wall precludes the formation of ice in the carbonated water within the tank. Since the outlet for carbonated water is disposed in the bottom wall of the tank and surrounded by the flat enlarged plate of the heat conducting element, this ensures that liquid carbonated water will flow out of the tank through the appropriate conduits to the mixing station of the post-mix beverage dispenser.

Because the carbonated water in the carbonator tank is always at a temperature which is very close the freezing point, the carbonator tank provides a very stable cooling source for the beverage concentrate containers in the concentrate storage compartment of the beverage dispenser. Thereby the single control means which controls the temperature of the carbonator tank can be utilized to cool both the carbonated water and the beverage concentrates in a very efficient and stable manner to provide a desired and consistent serving temperature for post-mix drinks.

Efficiency and stability of temperature control can be further enhanced by providing insulation in suitable portions of the beverage dispenser housing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus, are not limitative of the present invention and wherein:

BRIEF DESCRIPTION OF THE DRAWINGS

In the sole figure of the drawings there is illustrated in side elevation and partial cross-section the refrigeration system of the present invention including a heat conducting element coupling the beverage carbonator and the beverage concentrate storage compartment.

DETAILED DESCRIPTION OF PREFERRED EMBODIMENTS

The simplified and diagrammatic figure illustrates the device casing or cabinet 1 of a beverage dispenser. A carbonator 2 is installed and enclosed within insulating material to prevent heat loss. By a delivery pipe 4 water from a water source and $CO_2$ from another pipe 5 is run to this carbonator tank 2 in a conventional manner. Within this carbonator tank 2 the delivered water is mixed with the $CO_2$ that was fed from its supply pipe. Cooling coils 6 which together with a compressor 7, an evaporator 8 and a condenser 9 forms a mechanical refrigeration unit. The carbonator tank 2 is cooled such that a ring-shaped ice-bank 10 is formed about the interior side walls of carbonator tank 2. The thickness of the ice bank is measured by a sensor which is not shown in the sketch. Dependent upon the thickness of the ice bank 10 which is determined by the sensor, the compressor 7 is turned on and off to regulate the temperature of the carbonated water within tank 2.

In the lower wall of the carbonator tank 2 is an outlet 11 for the carbonated water. Responsive to the control mechanism of an outlet valve 12, this carbonated water is mixed with a beverage concentrate at a mixing station such as in a serving cup or post-mix drink to make up the final beverage.

The beverage concentrate 13 contained in a storage container 14 is conveyed to the carbonated water source by a mechanically driven pump 16 where it is mixed in the serving cup with carbonated water.

At the lower container wall of the carbonator 2—in the area of the outlet pipe 11 for the carbonated water—a heat conducting element 17 is installed in a curvilinear plate conforming to the shape of the lower wall of carbonator 2. Arms 18 and 19 extend into the storage room 15 and define rectangular walls thereof for surrounding and contacting tank 14 where beverage concentrate 13 is stored. From carbonator tank 2 the beverage concentrate 13 is essentially cooled without any heat loss, as the carbonated water stabilized by the ice bank 10 and located in the area of the installed heat conducting element 17 installed at carbonator 2 has a temperature that is near the freezing point and remains fairly constant.

In return, the heat conducting element 17 installed at carbonator tank 2 assures that the water remains liquid in the area in which the outlet pipe 11 ends and that no formation of ice takes place at this location. Beside the carbonator 2 the heat conducting element 17 also is insulated by surrounding material 20 to prevent heat loss from the surrounding area. This is illustrated by sectioned lines of the drawing.

Within the tank 14 containing the beverage concentrate 13 a loss of heat is observed as illustrated by the dotted lines. The coldest areas are in the vicinity of the wall sections 18 and 19 formed by the rectangular arms of the heat conducting element and defining part of the storage room 15 and also at the delivery location of the beverage concentrate.

With the housing of the beverage dispenser facing the service direction the storage room 15 is opened by a hinged or swinging door flap 21 so that the container 14 containing the beverage concentrate 13 can be taken out and replaced by a new storage tank with the same or other beverage concentrate. In the storage room 15 two or more concentrate tanks can be lined up side-by-side depending upon the design of the storage room.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In a refrigeration apparatus for a post-mix beverage dispenser including a carbonator tank for storing carbonated water, means for forming an ice bank of a controlled thickness in the carbonator tank, a carbonated water outlet in one wall of the carbonator tank, and a beverage concentrate storage compartment, the improvement comprising:

a heat conducting plate having an enlarged portion connected to said one wall of said carbonator tank closely adjacent said outlet and arms extending therefrom into said beverage concentrate storage compartment, said arms forming one or more walls of said storage compartment, whereby heat from beverage concentrate in the beverage concentrate storage compartment is transferred to the region of the carbonated water outlet to preclude freezing of the carbonated water in that region.

2. The apparatus of claim 1 wherein said enlarged portion is conformally shaped to said one wall and surrounds said carbonated water outlet.

* * * * *